US008628371B2

(12) United States Patent
D'Alleva et al.

(10) Patent No.: US 8,628,371 B2
(45) Date of Patent: Jan. 14, 2014

(54) TOY BANK AND ONLINE METHOD THEREOF

(76) Inventors: Jeanne D'Alleva, Needham, MA (US); Sheila Moylan, Westwood, MA (US)

( * ) Notice: Subject to any disclaimer, the term of this patent is extended or adjusted under 35 U.S.C. 154(b) by 178 days.

(21) Appl. No.: 12/329,994

(22) Filed: Dec. 8, 2008

(65) Prior Publication Data

US 2009/0149106 A1 Jun. 11, 2009

Related U.S. Application Data

(60) Provisional application No. 60/992,741, filed on Dec. 6, 2007.

(51) Int. Cl.
*A45C 1/12* (2006.01)
*A63H 33/26* (2006.01)

(52) U.S. Cl.
USPC ..... 446/8; 446/10; 446/71; 446/73; 446/175; 446/484; 434/107

(58) Field of Classification Search
USPC ..... 446/8–13, 175, 484, 71, 73; 434/107
See application file for complete search history.

(56) References Cited

U.S. PATENT DOCUMENTS

| | | | | |
|---|---|---|---|---|
| 4,673,368 | A | 6/1987 | Bush | |
| 5,716,211 | A | 2/1998 | Vetter | |
| 6,454,570 | B1 * | 9/2002 | Woods | 434/107 |
| 6,554,692 | B2 | 4/2003 | Knox, Jr. et al. | |
| 6,685,527 | B2 | 2/2004 | Johnson | |
| 6,890,179 | B2 | 5/2005 | Rogan et al. | |
| 6,896,573 | B1 * | 5/2005 | Rogers | 446/8 |
| 7,117,173 | B1 | 10/2006 | Ambani | |
| 7,149,336 | B2 | 12/2006 | Jones et al. | |
| 7,204,360 | B2 | 4/2007 | Rasmussen | |
| 2002/0119744 | A1 * | 8/2002 | Kwak | 453/1 |
| 2005/0287911 | A1 | 12/2005 | Schulze | |
| 2006/0157318 | A1 * | 7/2006 | Gao | 194/344 |
| 2007/0290032 | A1 * | 12/2007 | Main | 235/379 |
| 2008/0108272 | A1 * | 5/2008 | Lin | 446/8 |
| 2009/0176432 | A1 * | 7/2009 | Hardin et al. | 446/8 |

FOREIGN PATENT DOCUMENTS

| | | |
|---|---|---|
| DE | 19731414 | 1/1999 |
| EP | 1050867 | 11/2000 |
| ES | 2079286 | 1/1996 |

* cited by examiner

*Primary Examiner* — Dmitry Suhol
*Assistant Examiner* — Alex R. R. P. Rada, II
(74) *Attorney, Agent, or Firm* — Antoinette G. Giugliano; AGG Intellectual Property Law

(57) ABSTRACT

The present invention relates to a toy bank that includes a toy or toy housing, a money bank, and a computer interface in communication with the money bank. The money bank has a storage compartment; one or more unidirectional slots for receiving coins, dollar bills, or both; a compartment door at the storage compartment; and a processor to calculate an amount of coins, dollar bills, or both. The present invention also pertains to a toy bank that includes a pet carrier and a money bank, wherein the money bank is removably attached to the pet carrier. The present invention further relates to a toy bank that includes a toy and a money bank integrated with the toy. The present invention also includes systems and methods that incorporate the toy bank.

20 Claims, 5 Drawing Sheets

TOY BANK AND ONLINE METHOD THEREOF

RELATED APPLICATION

This application claims the benefit of U.S. Provisional Application No. 60/992,741, filed on Dec. 6, 2007.

The entire teachings of the above application is incorporated herein by reference.

BACKGROUND OF THE INVENTION

Parents often try to teach money-saving habits to their children. However, several products many times do not adequately teach children how to save money. In general, the products are either fairly simple or incorporate aesthetics in an attempt to make them more interesting to children. An interactive online toy banking system has not been available to encourage children to learn to save money and be familiar with the banking system in the real world while at the same time providing entertainment.

Hence, a need exists for an educational toy that teaches children about saving money. A further need exists to do so using a toy bank that has a pet-related or fun theme, and is part of a system that encourages saving through entertainment, especially in an on-line environment.

SUMMARY OF THE INVENTION

The present invention relates to a toy bank that includes a toy or toy housing, a money bank, and a computer interface in communication with the money bank. The money bank has a storage compartment; and one or more unidirectional slots for receiving coins, dollar bills, or both, which is disposed on an outer surface of the money bank, and communicates with the storage compartment. The present invention further includes a compartment door at the storage compartment; and a processor to calculate an amount of coins, dollar bills, or both. The present invention also relates to a money counter that is coupled to the slot and determines the value of the coin or bill being deposited into the storage compartment. The money counter can be mechanical or digital. In an embodiment, the money counter has a sensor that measures the diameter of the coin. In other embodiments, the money counter includes a scanner to identify the value of the coin or bill. The present invention can further include a display to indicate the total amount of money in the storage compartment. The present invention further includes a money bank having a compartment door with a lock for receiving a key. When unlocked, one can remove the coins, dollar bills, or both. The money bank also embodies a mechanism for resetting or revising the total amount after removal of one or more coins, dollar bills, or both.

The present invention also pertains to a toy bank that includes a pet carrier, a money bank, a computer interface in communication with the money bank, and an attachment to removably attach the money bank to the pet carrier. The pet carrier includes a pet housing for a toy pet, and a member that can be opened to receive or remove the toy pet. The money bank has a storage compartment; and one or more unidirectional slots for receiving coins, dollar bills, or both. The unidirectional slot is disposed on the outer surface of the money bank or toy, and communicates with the storage compartment. The present invention also embodies a compartment door at the storage compartment; a money counter that is coupled with the unidirectional slot; and a processor that is in communication with the money counter, and calculates an amount of coins, dollar bills, or both. In an embodiment, the pet-housing conforms to a shape of a house in which a roof acts as the member that can be opened, and the money bank conforms to a chimney that is removably attached to said house.

The present invention also relates to a toy bank that includes a toy, a money bank integrated with the toy, and a computer interface in communication with the money bank. The money bank has a storage compartment; one or more unidirectional slots as described herein; a compartment door at the storage compartment; a money counter; and a processor, also as described herein. In an embodiment, the storage compartment of the present invention is detachable.

The present invention also pertains to a toy bank system or kit comprising the elements of the present invention described herein. In an embodiment, the toy bank system includes a toy housing and a toy, wherein the toy housing has a member that can be opened to receive or remove the toy. The present invention embodies a money bank that includes a storage compartment, one or more unidirectional slots, a compartment door at the storage compartment, a money counter; and a processor, as described herein. The system of the present invention further includes a computer interface in communication with the money bank. In addition, an attachment is included in the present invention to allow for the money bank to be removably attached to the toy housing.

In an embodiment, the present invention also relates to a toy bank that includes a toy having a detachable unit and a base unit, a money bank integrated with the detachable unit, and a computer interface in communication with the money bank. The money bank has a storage compartment; one or more unidirectional slots; a compartment door at the storage compartment; a money counter; and a processor, all as described herein.

The present invention also relates to methods of using the toy bank described herein. The methods of the present invention include inserting one or more coins, bills or both into the money bank described herein, and identifying the money value of the coin, dollar bill, or both. The steps also include calculating an amount of coins, dollar bills, or both to thereby obtain a total amount, and downloading the total amount to a computer. The steps of the present invention can further include displaying the total amount. In an embodiment, the steps further include unlocking a lock on the money bank with a key, and remove one or more coins, dollar bills or both. The steps can also include resetting or revising the total amount based on the coins, dollar bills or both removed.

The present invention also relates to methods of educating a user in an online environment by using the toy bank described herein. The methods of the present invention include connecting the money bank into a computer through the computer interface; downloading the total amount to a computer; and engaging the user in online activities based on the total amount. In addition, children can register the toy bank using an access code received with the toy bank. The steps can also include converting the total amount to online points. Furthermore, the steps can include printing a bank deposit slip, a thank you note, or both. In an embodiment, the points can be used to save or invest in virtual accounts. In other embodiments, the points are used to play games. The games, in an aspect, teach math skills, money management, or both.

The present invention advantageously allows a child to save money in a fun way, and instills good saving habits through an interactive toy banking system in an online environment. The present invention also provides an incentive for children to save money by making the money bank part of a toy system and interactive online system, in turn, makes saving money more fun.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The present invention relates to a toy bank. The present invention is an educational toy designed to promote and teach money-saving habits in children, especially in an online environment, while being fun. Specifically, the present invention includes a toy or toy housing, a money bank, and a computer interface for online interactive communication with the money bank. In an embodiment, the money bank can be connected to a toy housing or toy by a removable attachment. In other embodiments, the money bank can be integrated with the toy.

Figure 1:
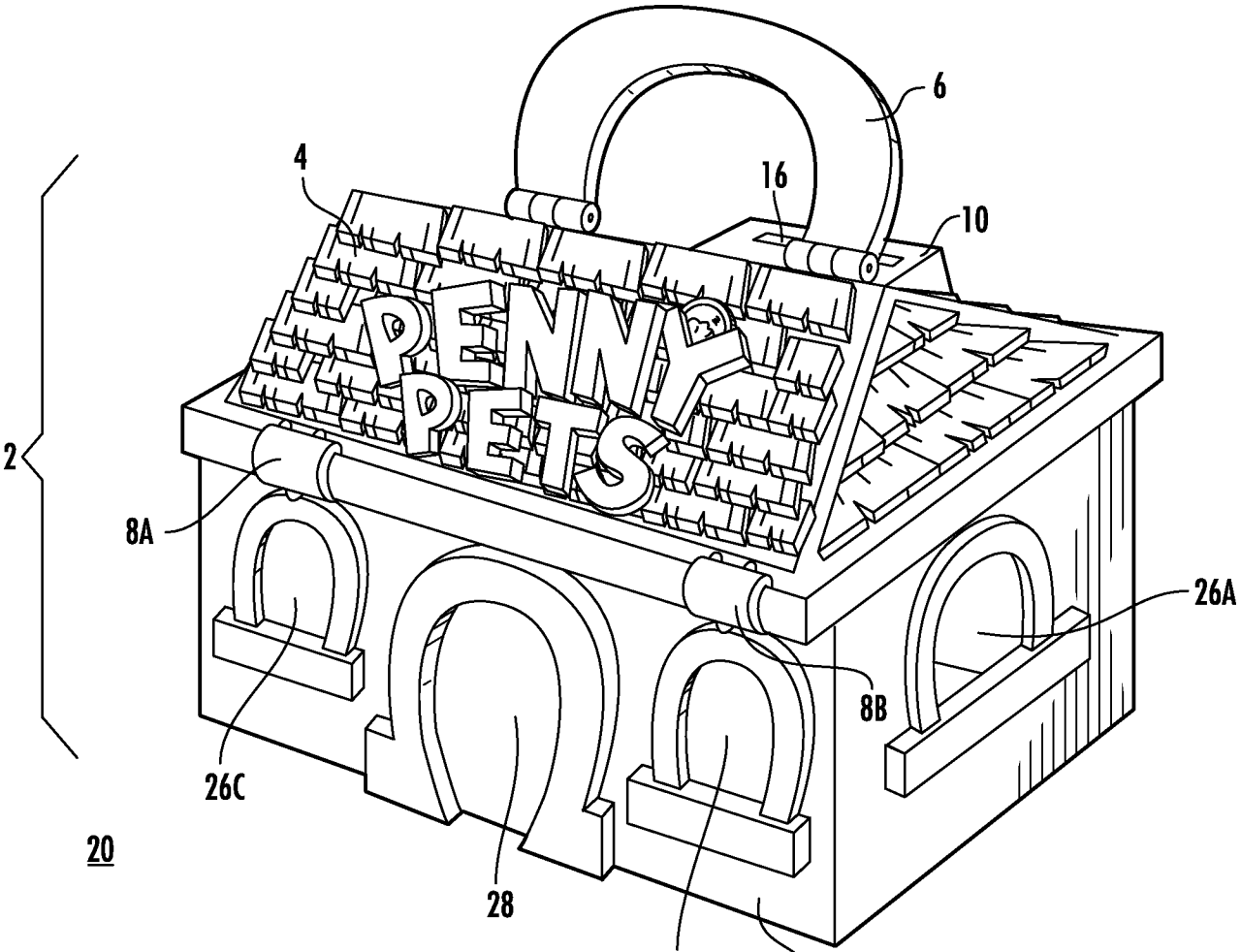
FIG. 1 is a front, perspective view of an embodiment of the present invention that includes a pet carrier and a money bank.

Referring to FIG. 1, the present invention, in an embodiment, includes toy bank 20 having pet carrier 2. In this embodiment, pet carrier 2 includes housing 12. Housing 12 includes windows 26A-C and door 28 having a horseshoe design. In addition, housing 12 has roof 4 with opens using hinges 14A and 14B to allow a toy pet (not shown) to be placed into pet carrier 2. In this embodiment, the toy housing of the present invention is shaped to form a pet carrier. However, the toy housing or toy bank, which is further described herein, can be shaped into any item to reflect a particular theme. The toy housing, money bank or toy bank, can be adapted for other themes such as dolls (e.g., a doll house with a money bank shaped as a chimney), sports (e.g., a sports bag with a money bank shaped as a ball; a sports figure, a ball), a musical instrument, an animal, a person (e.g., real, celebrity, or fictional), inanimate objects, various occupations (e.g., builder's tool box with a money bank shaped as a tape measure, or a doctor's medical kit with a money bank shaped as a stethoscope), any part of nature (e.g., flowers, sun), vehicles, etc. The toy housing can have doors and windows and any other accessories. The present invention can be made from any material suitable for a toy. Such material is known in the art and includes, e.g., plastic (e.g., molded or poured plastic), wood, metal, alloys, rubber, composites, or any combination thereof. Materials developed in the future can be used so long as the material is suitable for making the toy housing, toy bank, or money bank. Furthermore, the toy housing can be any shape including rectangular, square, triangular, polygonal, prism, rounded, and the like. The present invention can be decorated or have design elements consistent with the theme, e.g., with the pet theme. In other embodiments, the present invention further includes moving parts which can make sounds, talk, or light up.

In FIG. 1, latches 8A and 8B can be disengaged and roof 4 can be opened to allow one to place or remove a pet toy from the pet carrier. As such, roof 4 is a member (e.g., a door) that can be opened or closed to allow the placement or removal of a toy. In FIG. 1, the door forms the top portion of the housing and acts as a roof to the pet carrier/house. However, the door that allows the child to place the toy within it can be placed on any portion of the housing. For example, the door can be placed on the front of the housing, or on one of the sides. The door can be secured in any fashion, including with the use of latches, snaps, ties, fasteners, and the like. When the roof is open, a platform is revealed to allow for a play surface for the child using the toy animal. In other embodiments, the housing can have partitions, floors, and various rooms like a doll house.

Pet carrier 2 can further include handle 6. Handle 6 has a "C" shape with the ends of the "C" attached to roof 4 via a swivel hinge. One or more handles can be used. Handles are optional in an embodiment. Handles can be stationary, or can bend using a hinge or joint. Handles can also be molded into the housing to form grips with which the housing can be carried.

Figure 2:
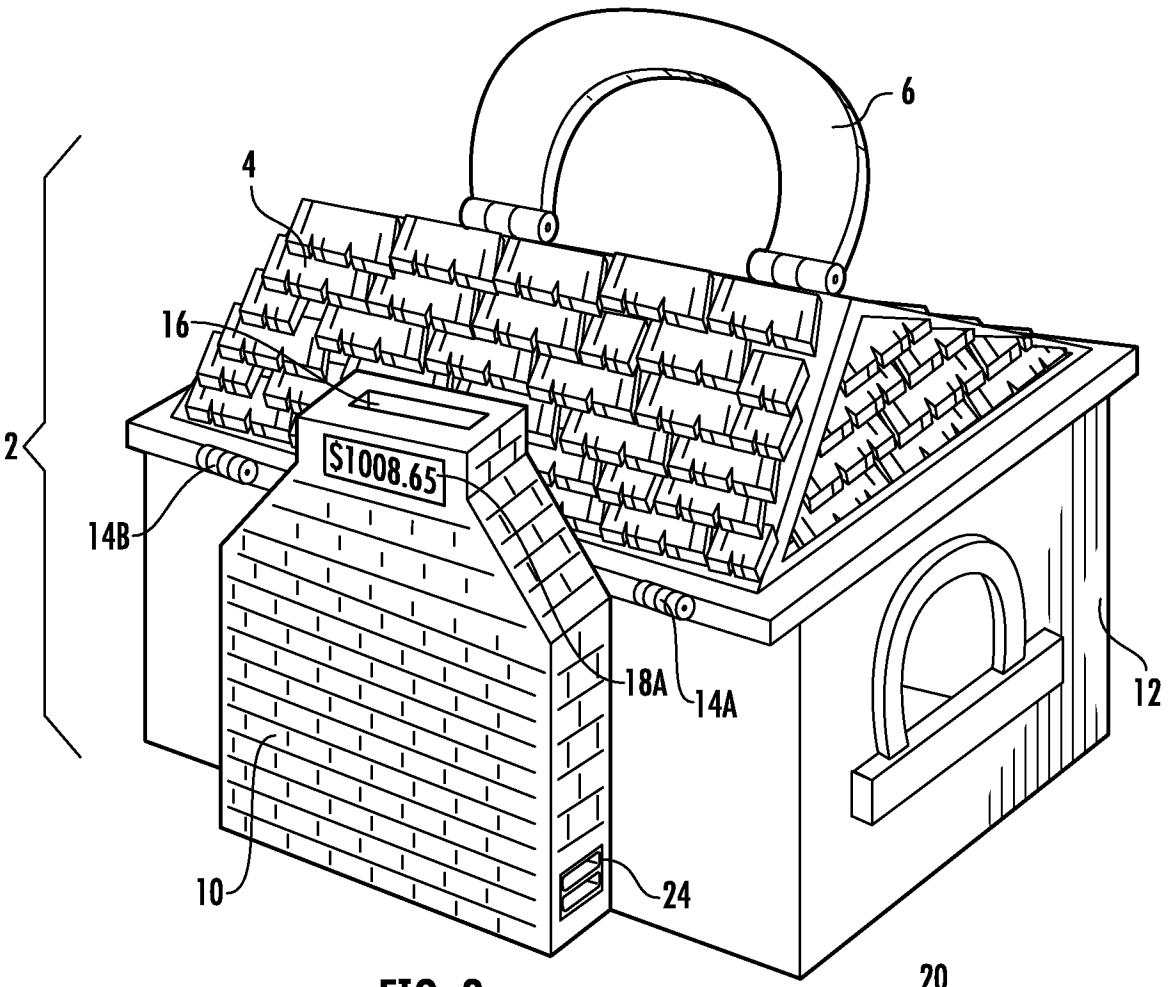
FIG. 2 is a back, perspective view of the embodiment shown in FIG. 1.

As better shown in FIG. 2, money bank 10 is attached to a back side (e.g., a back portion) of housing 12. Money bank 10 is removably attached to the pet carrier using a slide bar that slides into a slot mounted on or imbedded into the housing. Any configuration to removably attach the bank can be used. For example, the attachment can be a fastener, snaps, slide pin, complementary ends, etc.

In FIG. 2, money bank 10 is shaped into a chimney to complement the house-shaped pet-carrier. The money bank can be shaped into any form to complement the type of housing design.

Money bank 10 has slot 16 to receive one or more coins, bills (e.g., money bills or dollar bills), or any combination hereof (collectively referred to as "money"). Slot 16 is a slot that unidirectionally accepts money so that the child cannot remove the money after it has been deposited. To unidirectionally accept money the slot is large enough to accept coins or dollars, but not large enough for a child's fingers to fit therein. In an embodiment, more than one slot can be included in the bank. For example, a slot for coins and a second slot for bills can be used. The slot is in communication with the storage compartment. The storage compartment is a receptacle used to receive and store money. The storage compartment is defined by walls of the money bank, and as further described herein, can also be defined by the walls of the toy, in the case in which the money bank is integrated with the toy. The slot communicates with the storage compartment so that the money will be deposited from the slot to the storage compartment.

A money counter can be used with the money bank to determine the value of the coins and/or bills that passes through the one or more slots. As such, the money counter can include, be coupled with, or in communication with the unidirectional slot. For example, the bill amounts can be determined by the money counter which includes, in addition to one or more slots, a feed mechanism, scan heads, photodetector and a processor. A feed mechanism functions to pick out or accept one bill at a time for transfer to the storage compartment. This is done with a pair of scanheads where the denomination of the bill is identified. In an embodiment, each scanhead is an optical scanhead that scans for characteristic information from a scanned bill which is used to identify the denomination of the bill. Each optical scanhead, in an embodiment, comprises a pair of light sources directing light onto the storage compartment so as to illuminate a substantially rectangular light strip upon a currency bill positioned on the transport path adjacent the scanhead. The illuminated strip is sensed by a photodetector positioned between the two light sources. The analog output of the photodetector is converted into a digital signal by means of an analog-to-digital (ADC) convertor unit whose output is fed as a digital input to the processor (e.g., a central processing unit). The scanheads and the signal processing system can be designed to detect a variety of characteristic information from currency bills. See U.S. Pat. No. 7,149,336. Additionally, the scanheads can employ a variety of detection means such as magnetic, optical, electrical conductivity, and capacitive sensors.

Regarding the identification of a coin value, the money counter which includes, e.g., one or more channels, a coin presence detector, and a processor can be used. In an embodiment, when a user inserts a coin into a slot, the slot directs the inserted coin to a coin channel dependent on the diameter of the coin. Basically, the coin value can be determined by the diameter of the coin passing through the slot. A mechanical detection of the diameter of the coin can be performed which can communicate with the counter to add value to the total amount displayed. The coin channel can be formed as 2, 3- or 4-sided hollow channel of sufficient size to allow free movement of coins contained therein. The coin channel, in one aspect, can be slanted downward toward the storage compartment so that the force of gravity is sufficient to impel the coin through the channel. At some point within the coin channel is a coin presence detector (e.g., a pressure switch) which senses the passage of a coin through the coin channel. The coin presence detector can be any sort of electronic or mechanical apparatus which provides a signal or other suitable indication of the passage of the coin through the channel. As the coin passes through the coin presence detector, a change in the signal is created and transmitted as input to the processor. See U.S. Pat. No. 7,204,360.

The software or a processor routine of the processor evaluates these inputs from either the bill counter, the coin counter, or both and generates output to the display to reflect the balance in the storage compartment. Any mechanism for detecting the value of a coin, a dollar bill or both can be used including those known or developed in the future.

The money bank further includes a device that adds the value of the money inserted therein, and can display the value of the money passing through the slot. Once the value of the coin or bill passing through the slot is determined, the value is added to the previous, already determined balance. The device that adds the value can be performed using a processor that can keep track of the balance and add value of the coins entered into the bank. The processor has the ability to perform functions including addition, and subtraction, and other mathematical operations. The processor, in certain embodiments, assists in carrying out the activities described herein.

After the processor determines the value of the money that has passed by the slot(s), the monetary value can be displayed in dollars and cents, as shown in FIG. 2. Display 18A can be a mechanical display, e.g., of rolling numbers, or can be a digital display such as an LCD or LED display. In addition to displaying the total amount of money inside the money bank, the display can further include other information. Such information includes identifying information of the owner (e.g., the child's name), the balance on a bank account associated with the child or bank, a goal balance to achieve (e.g., $100), or if a goal balance is set, the amount of money needed to be saved to attain the goal (e.g., $15 to go).

Money bank 10 further includes a reclosable member (not shown) that optionally has a lock. The lock is engaged with a key, e.g., to be kept by a parent or a bank representative. The key opens the lock and allows the reclosable member to be open or removed, after which all or a portion of the money can be removed. The money can be removed for deposit into a bank account. After the money is removed, in one aspect, the counter is simply reset to zero. Alternatively and as further described herein, the money bank can be connected to a computer to communicate the balance within the money bank, within a bank account associated with the money bank, or both. In one aspect, if not all of the money is removed from the money bank, the mechanism to revise the balance can be engaged. The counter's balance can be modified manually by indicating how much money was removed, or by indicating the new balance. The counter's balance can be modified using up and down arrows, or using a keypad to indicate the balance. Any mechanism for resetting a numerical value on a display can be used including those known or developed in the future. For example, a reset button or switch can be used. Further, simply opening the money bank can reset the counter to zero.

The toy bank of the present invention further includes a computer interface (e.g., a USB port). In FIG. 1, computer interface 24 allows the money bank to be connected with a computer. Interaction with the computer can provide an exchange of information with respect to various areas including, e.g., personalization (e.g., child's name or song), updating the monetary balance, banking information (child's bank, child's savings account information that correlates to the bank), interaction with a website or software with games and activities relating to saving money, banking, mathematics, investing, giving, and the like. The interaction can be web-based, or software can be downloaded to the computer and then communicated, as needed, via the internet to the website or financial institution. In an embodiment, the money bank interacts with financial or accounting software (e.g., Quicken® or MS Money® financial software) and teaches a child how to keep track of their savings and reconcile a corresponding bank account. In other embodiments, the interactive website can also allow the children to print letters or thank-you notes for money received as gifts. As further described herein, the website also can, for example, print bank deposit slips which show the routing and account numbers. Links to the individual banks, e.g., to upload information, can be provided, as well as links to investments such as mutual fund companies. The USB port can be substituted with any type of computer connection or port that allows the money bank to communicate with a computer. An example of another such connector is a serial connector. In another embodiment, bank personnel plugs the USB port of the money bank into the bank computer to update the balance of the money bank.

Although not shown, an aspect of the present invention includes a key. A key can accompany the money bank to unlock a panel or door on the money bank. For example, a parent or banker can hold the key and open the bank when the child is ready to deposit the money into a savings account or use the money for an expenditure. The lock and key configuration can be a mechanical configuration in which the lock has a design that receives and complements the key, so when received, the key turns and unlocks the door, panel, or otherwise provide an opening to remove all or a portion of the saved money. After money is removed, the door or panel is closed and locked again. Alternatively, the key/lock configuration can also be an electronic key in which a personal code is entered which then releases the door, panel or provides an opening through which all or a portion of the saved money can be removed. Key and lock configurations known in the art or later developed can be used in conjunction with the money bank of the present invention.

The money bank having an electronic display and/or counter is powered either by a battery, or by an electrical outlet via an electrical cord. Power can also be supplied when connected to a computer via a computer port such as the USB port. In an embodiment, the battery acts as a back-up power supply to power LCD display that is not otherwise powered, e.g., when the computer is not on or connected, or when the electrical cord is not connected. The power source can be a battery, an A/C adaptor, a U/L approved plug/power cord, USB powered, solar, or any other power source known in the art or developed in the future. In addition to these electrical components, interactive functions utilizing sound effects, speech, visual or physical reaction, or music can be used.

An aspect of the present invention includes the money bank, and the toy housing separately, as well as the two items together via an attachment. Additionally, the present invention includes a system or kit that includes both the money bank and the toy housing, and in certain embodiments, a toy for placement in the housing (e.g., an animal, doll, figure, creature, person, vehicle, etc.).

Toy animals that accompany pet carrier and money bank are, in an embodiment, small plush animals with logos on feet bottom. All types of animals (e.g., dogs, cats, lions, penguins, turtles, etc.) can be used with the pet carrier embodiment. The animal pets can be purchased with the pet carrier and/or money bank, or separately. Logos, icons, soft plastic coins can be sewn-on in certain aspects. The toy can include a zippered panel that opens to reveal coin storage area, which can be used to store coins when soft toys are being carried around outside of the home. In an embodiment, a copper colored signature design element (like iris of animal or creature) can be included in each soft toy.

Figure 3:
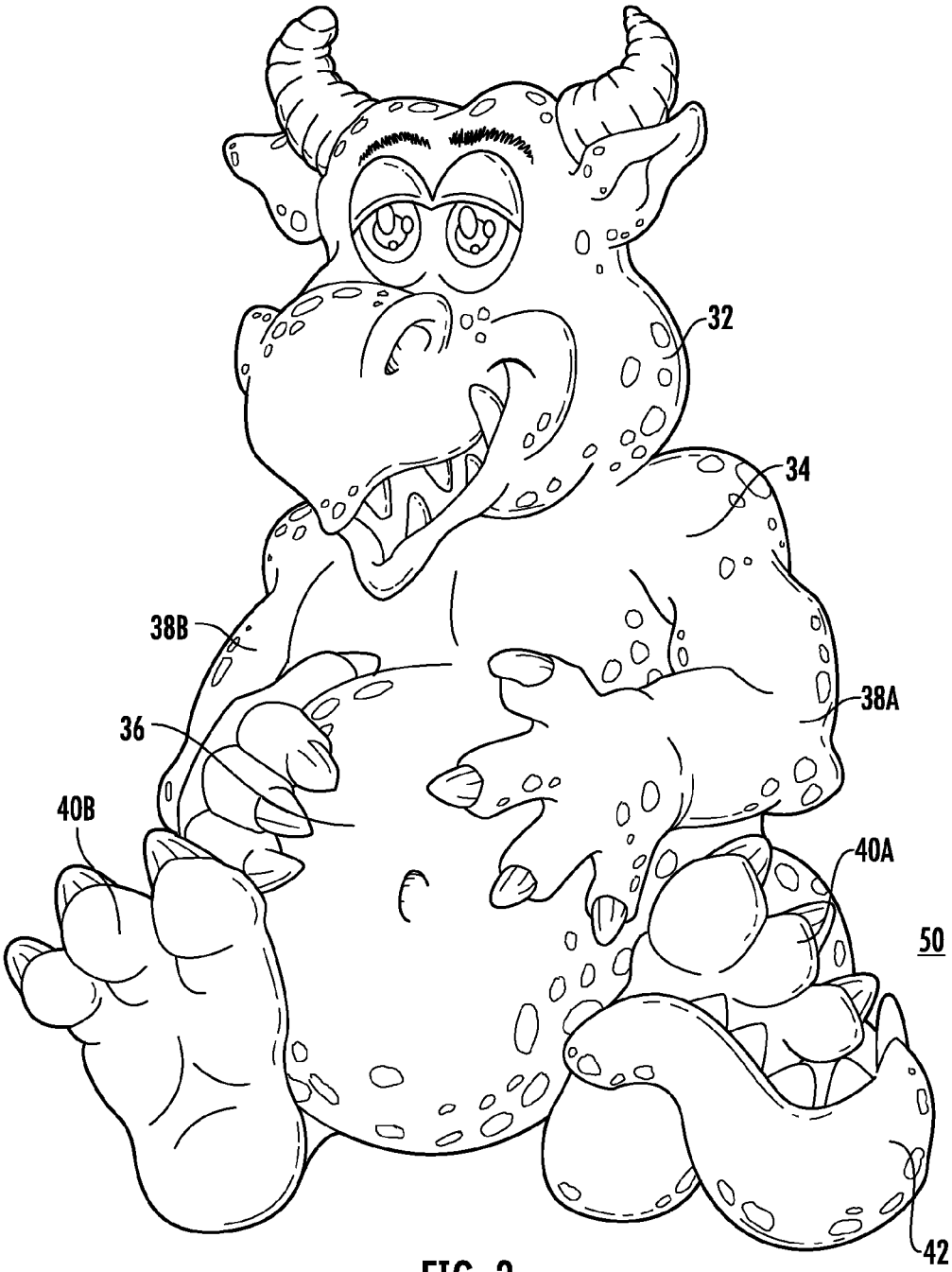
FIG. 3 is a front, perspective view of an embodiment of the present invention in which a money bank is integrated with a toy.
Figure 4:
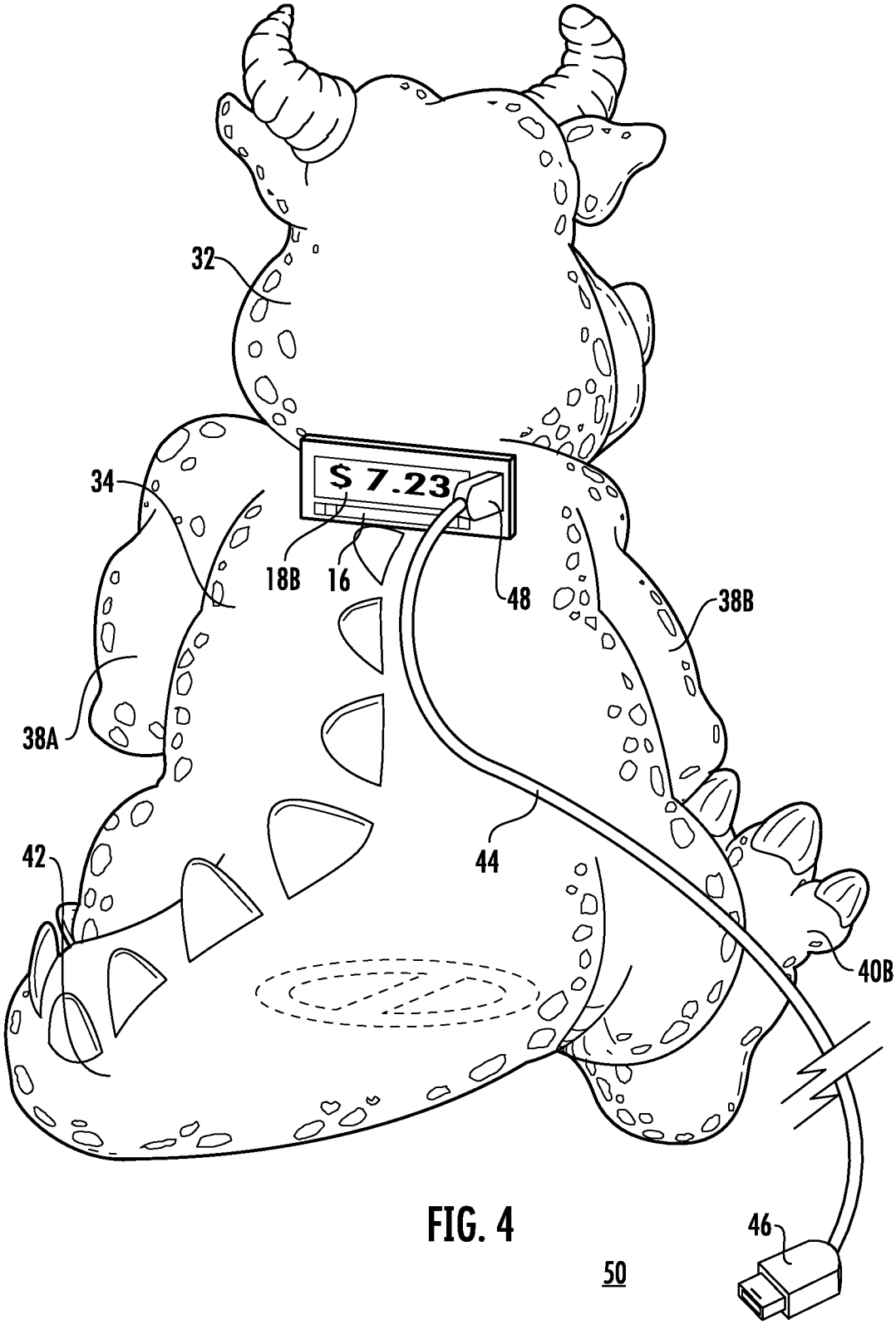
FIG. 4 is a back, perspective view of the embodiment shown in FIG. 3.

Referring to FIG. 3, in an embodiment of the present invention, toy bank 50 is shaped into a friendly monster or dinosaur. As described herein, the toy can be shaped as any character, figure, animal, doll, and the like. In this embodiment, toy bank 50 includes a money bank that is integrated into the toy itself. The toy bank of the present invention includes a storage compartment. The storage compartment can simply be a hollow compartment defined by the walls of toy bank 50. As shown in FIG. 4, the compartment door, which is described herein, can be opened to remove the deposited money. In other embodiments, the storage compartment can be in any portion of toy bank 50. For example, the storage compartment can be formed within any member of the toy bank, including head 32, arms 38A and/or 38B, belly 36, tail 42, or even in feet 40A and/or 40B. In such a case, the storage compartment is defined by walls of the toy member in which the storage compartment will reside. In another embodiment, the storage compartment is detachable. This is optional. The storage compartment member of the toy bank can be removed and reattached. The storage compartment can be part of a detachable unit, which is further described herein.

The storage compartment communicates with the unidirectional slot, as described herein. In the case in which the storage compartment is located far from the slot, the slot can be continuous from its opening to the storage compartment to ensure that the money is deposited into the compartment. The slot can also be coated with a slippery or a reduced-friction material to facilitate deposit of the money into the storage compartment.

In FIG. 4, the back view of money bank 50 is shown. In this embodiment, slot 16, display 18B, money counter, and a computer interface (e.g., USB port) are located on the back of the monster toy, just below its head. Slot 16 is located below the display and the USB port is located to the right of the display. Display 18B, slot 16, money counter, and the USB port are combined into a single unit. These parts can be physically separated so long as they communicate with one another. Additionally these parts can be arranged in any spatial order. Each of these parts is described in detail herein. The toy bank further includes computer interface 24 described herein, and, in one aspect, computer adapter 46.

Computer adapter 46 connects computer interface 24 on the toy bank and a port on a computer. The computer interface allows the toy bank to communicate with a computer and an online environment. Such a connection allows one to download information about the amount of money saved, to update a bank account balance, and to engage in recreational or educational online activities, which are further described herein. Any computer interface or communication device can be used so long as the toy bank communicates information to a computer. As defined herein, the phrase, "computer interface" includes communication devices. For example, the toy can have a wireless communication device (e.g., a built-in wireless card) to communicate with a computer network. Such devices are known in the art. Communication devices and computer interfaces now known or later developed can be used with the present invention. The online methods are further described herein.

The present invention further relates to a toy bank that includes a toy having one or more detachable units and a base unit. The detachable unit includes one or more of the money bank parts described herein. The detachable unit includes, in an embodiment, the storage compartment, the slot, the display, the money counter, the processor, the compartment door, the computer interface, or any combination thereof. In an embodiment, the storage compartment, slot, display, processor, and compartment door are included in the detachable unit so that a child can remove the detachable unit and take it to the bank and deposit the money into a bank account. In such a case in which the detachable unit has electrical components such as a digital display and processor, the unit will include a portable power source (e.g., rechargeable) such as battery or solar power. In another embodiment, the storage compartment can be an additional, separate detachable unit from the rest of the toy.

The base unit can be shaped or built to receive a detachable unit into an integrated toy bank. For example, the detachable unit and the base toy can complement one another to allow for the detachable unit to be removed and reattached. The detachable unit can attach to the base toy in a number of ways including being screwed into place, slid and locked into place, e.g., with a slide bar. The detachable unit can also be removably attached to the toy base with a fastener, magnets, complementary ends, slide pin, etc. In the case in which an electrical component such as the display or processor is in the detachable unit, the electrical component can communicate with the base when attached to the base through electrical prongs or connectors that connect to one another when the units are attached.

Figure 5:
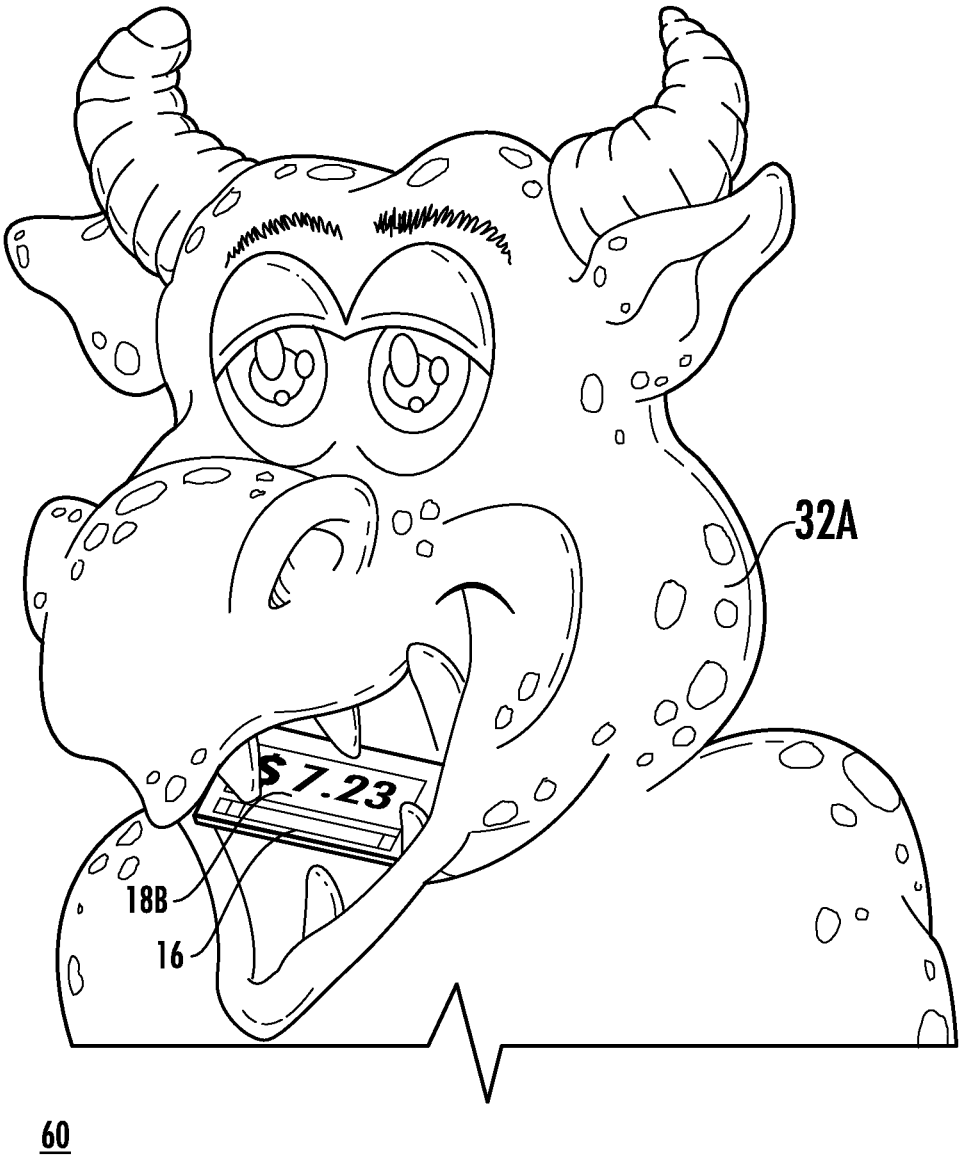
FIG. 5 is a front, perspective view of an embodiment of the present invention which shows a toy having the unidirectional slot in the mouth of the toy.

Referring to FIG. 5, toy bank 60 is shown with display 18B and slot 16 in the mouth of the monster figure. Head 32A can be configured or shaped to receive these components. For example, the mouth of the monster figure can be made wider and bigger, or shaped so that it is opened such that a child can insert money and see the display. In another embodiment, the mount can be configured to open and close, e.g., with hinges so that the child can gain access to the slot and display. In yet another embodiment, head 32A (e.g., a detachable unit) can be removably attached to the body (e.g., base unit). Although in an example the head is the detachable unit, any member of the toy bank can be the detachable unit. In this example, the detachable unit can be head 32, arms 38A and/or 38B, belly 36, tail 42, or even in feet 40A and/or 40B, and any combination thereof.

The kits or systems of the present invention include any combination of any member or item described herein. For example, the kits or systems of the present invention include: a toy, a toy housing, a toy bank, detachable and base units, slot, display, money counter, processor, computer interface, computer adaptor, storage compartment, and the like. The kits and systems of the present invention further include, in an aspect, computer related accessories, toy or educational money saving items. Examples of toy related items include toy grooming accessories, clothing, pet accessories (e.g., a dog bowl, a bone, dog toy, etc.) Money saving items include educational savings book, coin rolls, money bands, coin holders, deposit slips, a check register, and the like.

The present invention further relates to methods for saving money using the toy bank described herein. The present invention is designed to encourage a child to save money and deposit the saved money into a bank account, e.g., a savings account or money market account. Accordingly, the methods of the present invention involve inserting money through the slot of the money bank, identifying the money value, and calculating an amount of the money. In addition, the methods include downloading the total amount. The methods can further include displaying the total amount.

In the present invention, a compartment door or panel of the money bank can be unlocked and opened using a key, e.g., by the parent, child or bank personnel. All or a portion of the money can be deposited into a bank account. The balance of the bank can either be reset or typed in manually, or in an embodiment, electronically updated via the computer interface. In certain embodiments, local banks will be the only source to withdraw and deposit funds. In this embodiment, funds can be allocated into two accounts, a money market and saving account. The present invention can guide the child with investment strategies. For example, money can be allocated such that the money market has ⅓ of the funds and the savings account will hold ⅔ of the money. In an aspect, when the balance in savings is greater than or equal to a specific amount, e.g., $10.00 the money is then open to investments. Although dollar amounts are expressed in US dollars, any currency (e.g., Euros, Yen, Canadian dollars, Peso, etc.) can be used with the present invention. The present invention can be modified to accommodate different currency types.

The present invention also includes methods of educating a child in an online environment by using the toy bank described herein. In an embodiment, the toy bank of the present invention is connected to a computer via a computer interface (e.g., USB cord) or a wireless device and a child accesses the corresponding website address (e.g., www.moneymonster.com). In addition, a child can register the toy bank using an access code received with the toy bank. The access code can be any combination of numbers and letter, and is preferably unique to each toy bank. In one aspect, the access code can be included on hang tag or packaging. Access codes can be provided not only for the toy bank but also for any accessory that is purchased with the toy bank (e.g., stuffed animals, banking accessories, etc.). The access code can optionally provide additional online points, as further described herein. The code can activate the toy bank, provide starter points and/or provide bonus points. For example, a child purchasing bank deposit slips can receive additional online points in order to reward the child for planning to make deposits. In an embodiment, the unique code can reflect the type of animal, the color of the animal, etc.

Another step of the online methods includes, in an aspect, naming the toy bank of the present invention. A birth certificate can be optionally printed. The child can choose a username and a password to the online environment.

The online methods embody allowing a child to make a deposit. When the child first logs in, e.g., the child can be prompted to make an initial deposit into the toy bank. The counter will reflect a zero balance until a deposit is made. The child can make one or more deposits at any time. When the toy bank communicates with the online computer system, the balance and/or deposit information (amount of deposit, date of deposit, number of deposit, etc.) can be communicated to the online account. Additionally, withdrawals can be indicated if the child chooses to use a portion of the balance to make a purpose or invest in an investment tool (e.g., a bond, a fund, etc.). Accordingly, the online site can allow the child to create a statement showing the child's savings activity.

In an embodiment of the online methods of the present invention, the total amounts are additionally converted to online points in a virtual world on website. The money saved can be converted to points using any formula. For example, the dollar amount can equate to the amount of the coin (e.g., 1 penny equates to 1 point; a nickel equates to 5 points, a dime equates to 10 points). Alternatively, online points can be awarded based on the activity the child performs, and can be rewarded for good saving habits. For example, a child that saves 10 dollars in a month can be awarded more points than a child that saves 10 dollars in 2 months. A child can be awarded fewer points or no points for spending money on purchases, and more points for buying a savings bond. A child is also awarded points for playing online educational games that are related to saving money or math. A reward system can be put into place in which more points are earned when a user plays more difficult games or at different levels.

The child can use these points to "purchase" virtual accessories for their toy banks, "invest" in virtual savings account, play games and exchange "gifts" with other online users, and the like. The online environment can have areas for a child to shop and spend earned points. The more coins are deposited into the money bank, the more points can be used online. The more the child saves, the more points the child will have and the more the child can play. This online aspect provides an incentive for the child to save more money.

In other embodiments, the online methods include prompting the child to make a deposit at the bank when the child's balance reaches a desired amount. The amount can be preset, or set up the child or parent (e.g., on the online site). For example, once the balance in the money bank reaches $10.00, the child is prompted to make a deposit at a bank. In an aspect, the incentive for making the deposit is that the child can receive bonus points to play games or has access to different games (e.g., more advanced or fun games) as a reward for saving. Hence, the method includes prompting a child to make a deposit, and rewarding the child in the online environment with a reward (e.g., additional points, access to games, access to online activities such as sending an online friend a gift, a hug, etc.). An online reward is defined as a virtual reward attributed to the user's account that can be enjoyed by the user. Once the deposit is made, the child can enter the deposit on the website, or such information can be automatically downloaded from the toy, or inputted manually by the child. The use of term "child" is meant to encompass any user including a parent that is assisting the child in using the online site/process of the present invention. Furthermore, more than one user can access an account.

For example, a pressure sensitive switch can be in contact with the compartment door of the storage compartment. When the door is opened, then the switch is engaged. The switch, being in communication with the processor, will reset the display to zero. When the toy bank is next connected to the computer and the user is logged in, the new balance will be transmitted to the online site. When this occurs, the child can be asked whether s/he has deposited the money into their bank account, or if it was used for a purchase. In the case in which the money was deposited into their account, the child will be provided a reward for saving. In the case in which the child used the money to make a purchase, the child will not be provided with a reward, or the reward can be less that if the deposit was made. Alternatively, the child/user can simply enter that the deposit was made manually. The website can optionally ask for a parental confirmation that the deposit has been made.

As such, a key aspect of an embodiment of the online methods includes downloading the balance amount from the toy bank when the child logs in (e.g., each time the child logs in, or periodically such as every few days, weekly, by-weekly, monthly) and when the toy bank is in communication with the online site (e.g., connected via a USB cable). The online methods can further include a function which allows the child to request that the site download the balance amount from the toy bank. If there is a decrease in the balance of the storage compartment, the child will be asked if the money was deposited or if it was spent. If there is a change in the counter (e.g., an increase or a decrease), then the online methods embody prompting the child to 1) record a withdrawal, 2) record a deposit, 3) play games, or any combination thereof.

If the money was spent, the child can indicate how it was spent. Any withdrawals can be input as expenses such as toy purchases and gift purchases. Furthermore, icons can be used instead of word to communicate better with a child, especially a younger child. Examples of icons that can be used include symbols of: money, coins, deposit slips, bank, toys, clothes, food (e.g., ice cream). For example, an ice cream icon can be used by a child who wants to input the amounts spent on an ice cream cone.

In the virtual world, points can be deposited into spending, savings and investing accounts (e.g., to replicate real world savings behavior). Methods can be employed to allow a child to reach a certain savings goal (e.g., to save $100, or $10/month). Additionally, the online account of the present invention can interface with the online bank account information. Banks can provide a standard communication protocol so that the bank can communicate the balance, deposits, withdrawals, bank fees, and interested earned to the online account associated with the toy bank. Additional activities include bank reconciliation. Independent of an interface between the online website of the present invention and an online bank informational website, the present invention includes methods for reconciling the amount of the online toy bank account with that of a bank statement.

Additionally, games and activities can be geared toward a variety of ages, and can be based on counting, currency and math facts. Other similar activities include, producing financial statements, money management activities such as budgets, forecasting investments, coin identification, and identification of coin value. Specifically, games can teach math skills and/or money management. Games also include interactive games that teach colors or spelling. Games can also relate to spending the points with decorating the toy and/or the toy housing of the toy bank of the present invention. For example, the child can paint the toy housing and/or purchasing clothes for a toy animal. The game can further relate to playing songs for a user based on the information entered, such as the user's name, favorite color, and date of birth. Furthermore, the game can relate to the sports such as baseball. A child can play with another user, or a friend on their friend list. Examples of various game can be found in the exemplification.

The present invention also embodies computer systems and apparatus for carrying out the present invention in an online environment. The system or apparatus includes a source for providing the amount of money in the storage compartment and/or deposit information (e.g., date of deposit, amount of deposit, and the like), and if the compartment door was opened to indicate a deposit. The source can be, e.g., from memory storage, or a storage medium. The systems and apparatus further include a processor, coupled to the source, wherein the processor carries out the steps of the present invention described herein. Specifically, the processor can execute software or a processor routine to calculate the amount of money in the storage compartment. In another aspect, the toy bank of the present invention is connected via a computer interface to a computer system having online access. The computer receives, from the source, the balance of money in the storage compartment, or the amount of money removed from the storage compartment, and is downloaded to an online website. A server hosting the online website communicates with another processor to execute software or processor routines for carrying out the online activities. In particular, the processor uses this information to calculate the money saved or balance into online points and allows the user to execute online activities, as described herein. In this case, the display is the computer screen used by the child, a printer to print information from the online site, an email, a cell/smart phone, and the like. Additionally, systems of the present invention further include an output device (e.g, a display on the toy bank, or a computer) that provides the user with the amount of money deposited into the storage compartment, or its balance.

EXEMPLIFICATION

Example 1

Building the Money Monster Toy Bank

The money monster toy bank shown in FIG. 3 was made from a molded plastic material. The material specifically was combination of parts made from polypropelene, high impact styrene and ABS plastics. The mold was made from steel. The toy housing was made by creating steel, injection mold tooling. The molds are then placed in injection mold presses where the plastic material is injected into the molds. Finished plastic parts are generated from these molds and assembled using screws and sonic welding manufacturing methods. The height of the monster toy bank shown in FIG. 3 was 9 inches. In particular, the height of the head was 4 inches, and the body was about 5 inches. The width of the monster toy bank shown in the figure was about 6.5 inches.

The module is built from the following components: A money reader (e.g., bill reader, coin reader or both), a Liquid Crystal Display (LCD) screen to display the amount of money inserted at a given time and the total amount in the bank, a USB port (or other connectivity device) to connect the bank to the computer (via its own USB port), a Central Processing Unit (CPU) to convert the stored money information into a digital transmission that will connect to the user's web account through the computer, and a reset button to clear the stored money information from the LCD screen and CPU. The module is inserted into the body of the toy bank, and it is the area that money can be inserted into the bank. The bank has a coin removal cap on the bottom of the bank to enable the money to be removed.

Example 2

Online Games

Game 1: Money Balloons. For example, different color balloons can be assigned various values. A red balloon equals $0.05, a green balloon equals $0.01, a blue balloon equals 0.25, and a yellow balloon equals $1.00. The methods of the game includes asking a user to find 4 yellow balloons and when the user hits the balloon correctly, an additional 100 points are given. This game can also be interact with another user on another computer.

Game 2: Feed the Monster. The user needs 50 points to play the game. The monster has a name and a date of birth. The monster lives in a cave that needs to be decorated. To paint the cave will cost money—2000 points. Color palette will be at the bottom of the screen. Use the mouse to select the color and click on the wall to paint the wall. The monster will also need clothes to wear and shoes which also costs money. The store the monster visits also has sale and more items can be bought if it is purchased on sale. For each item that is bought on sale the user is awarded more points based on the savings of the sale.

Game 3: Songs plays for the user based on the information entered. The user needs 75 points to play. The user types in their name. There are sample four questions for the user to enter: 1. Select you favorite color; 2. select the month you were born; 3. select the day you were born; and 4. enter the name of your monster. The system sings a song: There are X days left until USER NAME'S birthday. Hurray USER NAME your birthday is in X months and X days. Your friend, MONSTER'S NAME loves you and his/her favorite color is COLOR THE USER ENTERED. Each time the song is played, the user receives 25 points to play.

Game 4: When the bank reaches $10.00 the system tells the user to take the coins to the bank to make a deposit. The bank will reset back to zero, after the trap door is opened. When the user inserts the USB into computer, the system will ask what happened to the money in the monster? The system will show either "Spent $" or "Deposited $" and the user selects then the option. If "Spent $" is selected the user has to enter where the money was spent. It provides options: Candy; ice cream; McDonalds; clothes; and items purchased. The user will enter where the money went to, and the system will keep the money for a mini income statement. If Deposited, the money will be added to the bank account in the balance sheet.

Game 5: Baseball. The child can play against the computer or a friend on his friend list. Each player has a team. A team member would go up to bat, he will be asked a math question. The question can be addition, subtraction, multiplication, or division, and player guesses the answer. If he answers right, then goes to first base, if not then counts as 1 strike . . . three strikes then time for the other player.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A toy bank system that comprises:

a. a toy or toy housing;

b. a money bank that includes:

i. a storage compartment;

ii. one or more unidirectional slots for receiving coins, dollar bills, or both, disposed on an outer surface of the money bank, wherein the slot communicates with the storage compartment;

iii. a compartment door at the storage compartment;

iv. a processor, wherein the processor calculates an amount of coins, dollar bills, or both in the storage compartment;

v. a display to indicate the amount of coins, dollar bills, or both in the money bank;

c. a gaming environment that is distinct from the money bank, wherein the gaming environment comprises an online server and a program for calculating points;

d. a computer interface in communication with the money bank, wherein the computer interface communicates information about the amount of coins, dollar bills or both in the storage compartment to the gaming environment, wherein the program retrieves the amount of coins, dollar bills or both from the storage compartment communicated by said computer interface as a factor in calculation of points for use in the gaming environment, wherein the program also awards points based on saving or investing habits in the gaming environment, wherein the points can change independently from and do not affect the amount of coins, dollar bills, or both in the toy bank, and wherein the program uses points and not the amount of coins, dollar bills, or both in the gaming environment.

2. The toy bank system of claim 1, further including a money counter, coupled to the slot, for determining the value of the coin or the bill.

3. The toy bank system of claim 2, wherein the money counter is mechanical or digital.

4. The toy bank system of claim 2, wherein the money counter has a sensor that measures the diameter of the coin.

5. The toy bank system of claim 2, wherein the money counter includes a scanner to identify the value of the coin or bill.

6. The toy bank system of claim 1, wherein the compartment door has a lock for receiving a key, wherein, when unlocked, one can remove the coins, dollar bills, or both.

7. The toy bank system of claim 6, wherein the money bank includes a mechanism for resetting or revising the total amount after removal of one or more coins, dollar bills, or both.

8. A toy bank system that comprises:

a. a toy;

b. a money bank integrated with the toy, wherein the money bank comprises:

i. a storage compartment;

ii. one or more unidirectional slots for receiving coins, dollar bills, or both, disposed on an outer surface of the money bank, wherein the slot communicates with the storage compartment;

iii. a compartment door at the storage compartment;

iv. a money counter coupled with the unidirectional slot;

v. a processor, in communication with the money counter, wherein the processor calculates an amount of coins, dollar bills, or both; and vi. a display to indicate the amount of coins, dollar bills, or both in the money bank;

c. a gaming environment that is distinct from the money bank, wherein the gaming environment comprises an online server and a program for calculating points;

d. a computer interface in communication with the money bank, wherein the computer interface communicates information about the amount of coins, dollar bills or both in the storage compartment to the gaming environment, wherein the program retrieves the amount of coins, dollar bills or both from the storage compartment communicated by said computer interface as a factor in calculation of points for use in the gaming environment, wherein the program also awards points based on saving or investing habits in the gaming environment, wherein the points can change independently from and do not affect the amount of coins, dollar bills, or both in the toy bank, and wherein the program uses points and not the amount of coins, dollar bills, or both in the gaming environment.

9. The toy bank system of claim 8, wherein the storage compartment is detachable.

10. A toy bank system that comprises:

a. a toy having:

i. a detachable unit; and ii. a base unit that removably receives the detachable unit;

b. a money bank integrated with the detachable unit, wherein the money bank comprises:

i. a storage compartment;

ii. one or more unidirectional slots for receiving said coins, dollar bills, or both, wherein the slot communicates with the storage compartment;

iii. a compartment door at the storage compartment;

iv. a money counter coupled with the unidirectional slot;

v. a processor, in communication with the money counter, wherein the processor calculates an amount of coins, dollar bills, or both; and vi. a display to indicate the amount of coins, dollar bills, or both in the money bank;

c. a gaming environment that is distinct from the money bank, wherein the gaming environment comprises an online server and a program for calculating points;

d. a computer interface in communication with the money bank, wherein the computer interface communicates information about the amount of coins, dollar bills or both in the storage compartment to the gaming environment, wherein the program retrieves the amount of coins, dollar bills or both from the storage compartment communicated by said computer interface as a factor in calculation of points for use in the gaming environment, wherein the program also awards points based on saving or investing habits in the gaming environment, wherein the points can change independently from and do not affect the amount of coins, dollar bills, or both in the toy bank, and wherein the program uses points and not the amount of coins, dollar bills, or both in the gaming environment.

11. The toy bank system of claim 10, further including a money counter, coupled to the slot, for determining the value of the coin or the bill.

12. The toy bank system of claim 11, wherein the money counter is mechanical or digital.

13. The toy bank system of claim 11, wherein the money counter has a sensor that measures the diameter of the coin.

14. The toy bank system of claim 11, wherein the money counter includes a scanner to identify the value of the coin or bill.

15. The toy bank system of claim 10, wherein the compartment door has a lock for receiving a key, wherein, when unlocked, one can remove the coins, dollar bills, or both.

16. The toy bank system of claim 15, wherein the money bank includes a mechanism for resetting or revising the total amount after removal of one or more coins, dollar bills, or both.

17. A method of using a toy bank system, wherein the toy bank system comprises: a toy or toy housing; a money bank that includes a storage compartment, one or more unidirectional slots for receiving coins, dollar bills, or both, a money counter, coupled to the unidirectional slot, for determining the value of the coin or the bill, a compartment door at the storage compartment, a display to indicate the amount of coins, dollar bills, or both in the money bank; and a processor, wherein the processor, in communication with the money counter, calculates an amount of coins, dollar bills, or both; a gaming environment that is distinct from the money bank, wherein the gaming environment comprises an online server and a program for calculating points; and a computer interface in communication with the money bank; wherein the method comprises the steps of:

a. inserting one or more coins, dollar bills, or both into the unidirectional slot;

b. identifying the money value of the coin, dollar bill, or both with the money counter coupled to the unidirectional slot;

c. calculating an amount of coins, dollar bills, or both with the processor, in communication with the money counter, to thereby obtain a total amount; and d. downloading the total amount to a computer using the computer interface in communication with the money bank, wherein the computer interface communicates information about the total amount in the storage compartment to the gaming environment, wherein the program retrieves the total amount of coins, dollar bills or both from the storage compartment communicated by said computer interface as a factor in calculation of points for use in the gaming environment, wherein the program also awards points based on saving or investing habits in the gaming environment, wherein the points can change independently from and do not affect the amount of coins, dollar bills, or both in the toy bank, and wherein the program uses points and not the amount of coins, dollar bills, or both in the gaming environment.

18. The method of claim 17, further includes displaying the total amount.

19. The method of claim 18, further includes unlocking a lock on the money bank and removing one or more coins, dollar bills or both.

20. The method of claim 19, further including resetting or revising the total amount based on the coins, dollar bills or both removed.

* * * * *